US010899423B2

(12) United States Patent
Saito et al.

(10) Patent No.: US 10,899,423 B2
(45) **Date of Patent: *Jan. 26, 2021**

(54) OUTBOARD MOTOR RAISING/LOWERING DEVICE

(71) Applicant: SHOWA CORPORATION, Saitama (JP)

(72) Inventors: Takahiko Saito, Fukuroi (JP); Yoshimitsu Komuro, Fukuroi (JP); Hayato Tsutsui, Fukuroi (JP)

(73) Assignee: SHOWA CORPORATION, Saitama (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/438,096

(22) Filed: Jun. 11, 2019

(65) Prior Publication Data

US 2019/0367144 A1 Dec. 5, 2019

Related U.S. Application Data

(63) Continuation of application No. PCT/JP2017/033689, filed on Sep. 19, 2017.

(30) Foreign Application Priority Data

Jan. 30, 2017 (JP) ..... 2017-014482
Jul. 27, 2017 (JP) ..... 2017-145831

(51) Int. Cl.
*B63H 5/125* (2006.01)
*B63H 20/08* (2006.01)
(Continued)

(52) U.S. Cl.
CPC ..... *B63H 20/10* (2013.01); *B63H 20/00* (2013.01); *B63H 20/02* (2013.01); *B63H 20/08* (2013.01);
(Continued)

(58) Field of Classification Search
CPC ..... B63H 20/08; B63H 20/10; F15B 15/1409; F15B 15/1428; F15B 15/1447; F15B 15/1449; F15B 15/18
(Continued)

(56) References Cited

U.S. PATENT DOCUMENTS 3,722,455 A 3/1973 Carpenter
3,839,986 A * 10/1974 Meyer ..... B63H 20/10 440/61 R
(Continued)

FOREIGN PATENT DOCUMENTS

JP 58-028159 6/1983
JP 60-234096 11/1985
(Continued)

OTHER PUBLICATIONS

Allowance for JP 2017-145831, dated Feb. 6, 2018, 4 pages.
(Continued)

*Primary Examiner* — Daniel V Venne
(74) *Attorney, Agent, or Firm* — Casimir Jones, SC; Robert A. Goetz

(57) ABSTRACT

Provided is an outboard motor raising and lowering apparatus that is capable of automatically changing the speed of raising/lowering an outboard motor according to a status of the outboard motor. The outboard motor raising and lowering apparatus (1) includes: a first fluid passage that connects a pump (42), a second chamber(s) of one or more tilt cylinders (14), and a second chamber(s) of one or more trim cylinders (12); a second fluid passage that is connected to the first chamber of at least one of the one or more trim cylinders; and a switching valve (60) provided at the second fluid passage.

11 Claims, 12 Drawing Sheets

(51) Int. Cl.

| | |
|---|---|
| ***B63H 20/10*** | (2006.01) |
| ***B63H 20/02*** | (2006.01) |
| ***F15B 11/08*** | (2006.01) |
| ***B63H 20/00*** | (2006.01) |
| ***F15B 11/16*** | (2006.01) |
| ***F15B 15/14*** | (2006.01) |
| *F15B 15/18* | (2006.01) |

(52) U.S. Cl.
CPC ..... *F15B 11/08* (2013.01); *F15B 11/16* (2013.01); *F15B 15/1409* (2013.01); *F15B 15/149* (2013.01); *F15B 15/1428* (2013.01); *F15B 15/1447* (2013.01); *F15B 15/18* (2013.01)

(58) Field of Classification Search
USPC ..... 440/53, 61 R, 61 C, 61 T, 61 D, 61 E, 440/61 F, 61 G, 61 H, 61 J
See application file for complete search history.

(56) References Cited

U.S. PATENT DOCUMENTS

| | | | | | |
|---|---|---|---|---|---|
| 4,391,592 | A * | 7/1983 | Hundertmark | B63H 20/10 | 440/53 |
| 4,557,696 | A * | 12/1985 | Nakahama | B63H 20/10 | 440/61 D |
| 4,786,263 | A * | 11/1988 | Burmeister | B63H 20/10 | 440/53 |
| 4,909,766 | A | 3/1990 | Taguchi | | |
| 5,032,094 | A | 7/1991 | Katogi | | |
| 5,067,919 | A | 11/1991 | Okita | | |
| 5,215,484 | A * | 6/1993 | Saito | B63H 21/265 | 440/61 D |
| 5,358,436 | A * | 10/1994 | Soda | B63H 21/265 | 440/55 |
| 5,444,979 | A * | 8/1995 | Funami | F15B 7/006 | 137/106 |
| 5,447,456 | A * | 9/1995 | Nakayasu | B63H 21/265 | 114/150 |
| 6,048,235 | A * | 4/2000 | Kai | B63H 20/10 | 440/61 D |
| 6,139,380 | A * | 10/2000 | Uematsu | B63H 20/10 | 440/61 D |
| 6,276,976 | B1 * | 8/2001 | Saito | B63H 20/10 | 440/61 D |
| 6,296,535 | B1 * | 10/2001 | Bland | B63H 20/10 | 440/61 D |
| 6,309,265 | B1 * | 10/2001 | Oguma | B63H 20/10 | 440/53 |
| 6,461,205 | B1 * | 10/2002 | Banba | B63H 20/10 | 440/61 D |
| 6,837,761 | B2 * | 1/2005 | Saito | B63H 20/10 | 440/61 D |
| 6,948,988 | B2 * | 9/2005 | Okabe | B63H 20/08 | 440/53 |
| 7,407,420 | B2 * | 8/2008 | Fetchko | B63H 20/10 | 440/53 |
| 8,025,006 | B2 * | 9/2011 | Baros | B63H 20/10 | 440/56 |
| 8,046,122 | B1 | 10/2011 | Barta et al. | | |
| 8,435,088 | B2 * | 5/2013 | Morettin | B63H 20/10 | 440/53 |
| 8,840,439 | B1 * | 9/2014 | Wiatrowski | B63H 20/10 | 440/61 T |
| 8,851,944 | B1 * | 10/2014 | Wiatrowski | B63H 20/08 | 440/61 A |
| 9,290,252 | B1 | 3/2016 | Tuchscherer et al. | | |

FOREIGN PATENT DOCUMENTS

| | | |
|---|---|---|
| JP | 62-83298 | 4/1987 |
| JP | 64-28095 | 1/1989 |
| JP | 2-99494 | 4/1990 |
| JP | 2-102892 | 4/1990 |
| JP | 4-163292 | 6/1992 |
| JP | 4-368295 | 12/1992 |
| JP | 8-270608 | 10/1996 |
| JP | 9-11987 | 1/1997 |

OTHER PUBLICATIONS

Office Action for JP 2017-145831, dated Oct. 31, 2017, 9 pages.
English translation of International preliminary report on patentability of PCT/JP2017/033689, dated Aug. 8, 2019, 10 pages.
International Search Report for PCT/JP2017/033689, dated Nov. 7, 2017, 2 pages.
English translation of International preliminary report on patentability of PCT/JP2017/033688, dated Aug. 8, 2019, 13 pages.
International Search Report for PCT/JP2017/033688, dated Nov. 7, 2017, 2 pages.
Allowance for JP2017-145830, dated Feb. 6, 2018, 5 pages.
Office Action for JP2017-145830, dated Oct. 31, 2017, 13 pages.
Office Action for JP2017-014482, dated May 30, 2017, 9 pages.
Office Action for JP Patent Application No. JP2016-194890, dated May 30, 2017, 7 pages.
International Search Report of PCT/JP2017/011178, dated Jun. 6, 2017, 2 pages.
International preliminary report on patentability of PCT/JP2017/011178, dated Apr. 4, 2019, 5 pages.
Office Action for U.S. Appl. No. 16/438,051, dated Jul. 14, 2020.

* cited by examiner

OUTBOARD MOTOR RAISING/LOWERING DEVICE

TECHNICAL FIELD

An embodiment of the present invention relates to an outboard motor raising and lowering apparatus for raising and lowering an outboard motor provided to a hull.

BACKGROUND ART

In the field of watercrafts, outboard motor raising and lowering apparatuses have been known, which include: a tilt cylinder(s) used mainly to raise an outboard motor out of the water and lowering the outboard motor into the water; and a trim cylinder(s) used mainly to change the angle of the outboard motor underwater (for example, Patent Literature 1 and 2).

CITATION LIST

Patent Literature

[Patent Literature 1]
Japanese Examined Patent Application Publication,
[Patent Literature 2]
Japanese Patent Application Publication, Tokukaihei, No. 2-99494

SUMMARY OF INVENTION

Technical Problem

Incidentally, an outboard motor raising and lowering apparatus is preferably capable of suitably changing the speed of raising/lowering of the outboard motor.

An object of an embodiment of the present invention is to provide an outboard motor raising and lowering apparatus that is capable of suitably changing the speed of raising/lowering of an outboard motor.

Solution to Problem

In order to attain the above object, an embodiment of the present invention is directed to an outboard motor raising and lowering apparatus configured to raise and lower an outboard motor, the outboard motor raising and lowering apparatus including: one or more tilt cylinders; and one or more trim cylinders, each of the one or more trim cylinders including a piston that partitions each of the one or more trim cylinders into a first chamber and a second chamber, and a rod that is connected to the piston and that passes through the first chamber of each of the one or more trim cylinders, each of the one or more tilt cylinders including a piston that partitions each of the one or more tilt cylinders into a first chamber and a second chamber, and a rod that is connected to the piston and that passes through the first chamber of each of the one or more tilt cylinders, the outboard motor raising and lowering apparatus including: a hydraulic pressure source; a first fluid passage that connects the hydraulic pressure source, the second chamber(s) of the one or more tilt cylinders, and the second chamber(s) of the one or more trim cylinders; a second fluid passage that is connected to the first chamber of at least one of the one or more trim cylinders; and at least one switching valve provided at the second fluid passage.

Advantageous Effects of Invention

According to an embodiment of the present invention, it is possible to suitably change the speed of raising/lowering of an outboard motor.

DESCRIPTION OF EMBODIMENTS

Embodiment 1

The following description will discuss an outboard motor raising and lowering apparatus 1 in accordance with Embodiment 1 of the present invention, with reference to FIGS. 1 to 4.

Figure 1:
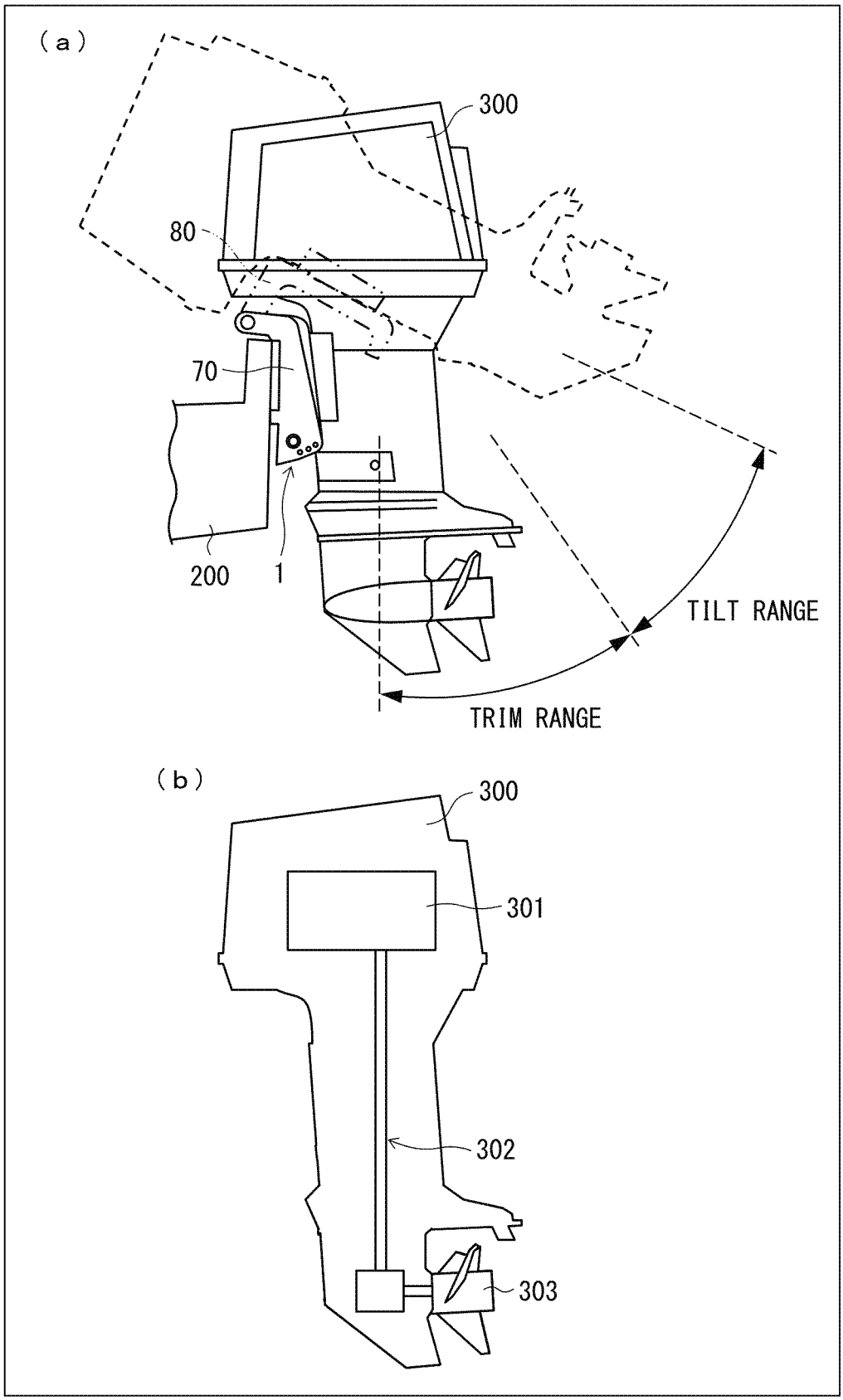
FIG. 1 illustrates an example of use of an outboard motor raising and lowering apparatus in accordance with Embodiment 1, and schematically illustrates an internal structure of an outboard motor.

The outboard motor raising and lowering apparatus is an apparatus that serves to raise and lower an outboard motor 300. (a) of FIG. 1 illustrates an example of use of the outboard motor raising and lowering apparatus 1, in which the outboard motor raising and lowering apparatus 1 is attached to the stern of a hull (main part) 200 and to the outboard motor 300. The solid line in (a) of FIG. 1 represents the outboard motor 300 in its lowered position, whereas the dashed line in (a) of FIG. 1 represents the outboard motor 300 in its raised position. (b) of FIG. 1 schematically illustrates an internal structure of the outboard motor 300. As illustrated in (b) of FIG. 1, the outboard motor 300 includes: an engine 301; a propeller 303; and a power transmission mechanism 302 that transmits power from the engine 301 to the propeller 303. The power transmission mechanism in this arrangement is constituted by, for example, a shaft and gears.

Figure 2:
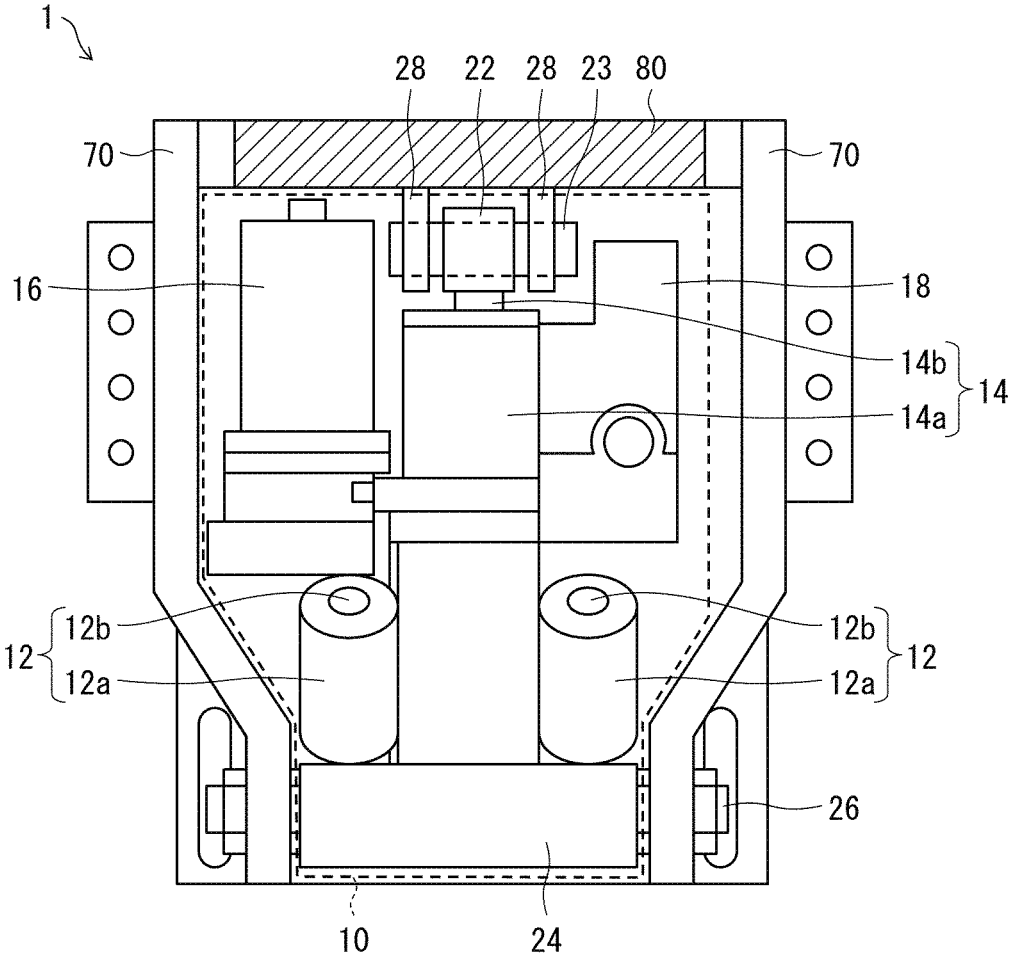
FIG. 2 is a front view illustrating one example of a configuration of the outboard motor raising and lowering apparatus in accordance with Embodiment 1.
Figure 3:
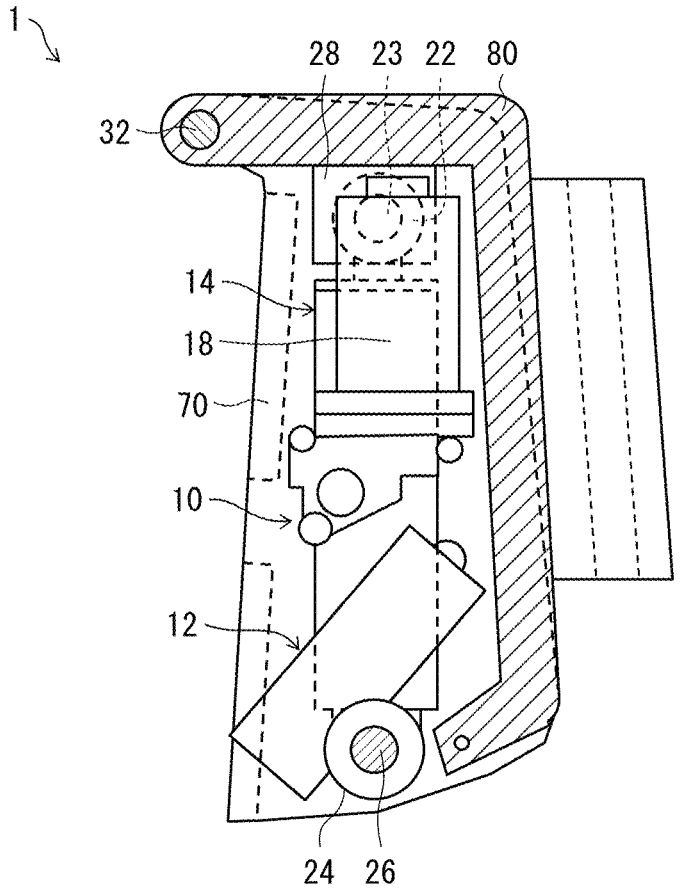
FIG. 3 is a lateral cross-sectional view of the outboard motor raising and lowering apparatus in accordance with Embodiment 1.

FIG. 2 is a front view illustrating one example of a configuration of the outboard motor raising and lowering apparatus 1, and FIG. 3 is a lateral cross-sectional view of the outboard motor raising and lowering apparatus 1. As illustrated in FIG. 2, the outboard motor raising and lowering apparatus 1 includes: a cylinder unit 10; a pair of stern brackets 70 for attachment to the stern of the hull 200; and a swivel bracket 80 for attachment to the outboard motor 300.

The cylinder unit 10 includes, for example: two trim cylinders 12, one tilt cylinder 14, a motor 16, a tank (storage tank) 18, an upper joint 22, and a base 24, as illustrated in FIG. 2. The trim cylinders 12 and the tilt cylinder 14 are provided such that they cannot move relative to the base 24.

Note that the number of the trim and tilt cylinders 12 and 14 included in the cylinder unit 10 is not intended to limit Embodiment 1, and that Embodiment 1 encompasses any cylinder unit 10 that includes one or more trim cylinders 12 and one or more tilt cylinders 14. The following explanation holds also for such a cylinder unit 10 that includes one or more trim cylinders 12 and one or more tilt cylinders 14.

The trim cylinders 12 each include: a cylinder barrel 12*a*; a piston 12*c* (see FIG. 4) slidably disposed within the cylinder barrel 12*a*; and a piston rod 12*b* secured to the piston 12*c*. The tilt cylinder 14 includes: a cylinder barrel 14*a*; a piston 14*c* (see FIG. 4) slidably disposed within the cylinder barrel 14*a*; and a piston rod 14*b* secured to the piston 14*c*.

Furthermore, as illustrated in FIG. 2, the base 24 and the stern brackets 70 each have a through-hole. The base 24 and the stern brackets 70 are connected to each other via a lower shaft 26 passing through these through-holes such that the base 24 and the stern brackets 70 can rotate relative to each other.

Furthermore, as illustrated in FIG. 2, the upper joint 22 is provided at the tip of the piston rod 14*b*, and the swivel bracket 80 has supporting members 28 secured thereto. The upper joint 22 and the supporting members 28 each have a through-hole, and the upper joint 22 and the swivel bracket 80 are connected to each other via an upper shaft 23 passing through these through-holes such that the upper joint 22 and the swivel bracket 80 can rotate relative to each other.

Moreover, the stern brackets 70 and the swivel bracket 80 each have a through-hole at one end of an upper portion thereof, and, as illustrated in FIG. 3, the stern brackets 70 and the swivel bracket 80 are connected to each other via a support shaft 32 passing through these through-holes such that the stern brackets 70 and the swivel bracket 80 can rotate relative to each other.

(Trim Range and Tilt Range)

The ascending or descending motion of the piston rod 14*b* of the tilt cylinder 14 raises or lowers the swivel bracket 80, resulting in raising or lowering of the outboard motor 300.

By means of the ascending and descending motions of the piston rod 14*b* of the tilt cylinder 14, the angle of the outboard motor 300 is adjusted within an angle range, which is composed of a trim range and a tilt range illustrated in (a) of FIG. 1. The tilt range is an angle range such that, when the angle of the outboard motor 300 is within this range, the tips of the piston rods 12*b* of the trim cylinders 12 cannot abut the swivel bracket 80. The angle of the outboard motor 300 in the tilt range is adjusted using the piston rod 14*b* of the tilt cylinder 14.

On the other hand, the trim range is an angle range such that, when the angle of the outboard motor 300 is within this range, the tips of the piston rods 12*b* of the trim cylinders 12 can abut the swivel bracket 80. The angle of the outboard motor 300 in the tilt range can be adjusted using both the piston rods 12*b* of the trim cylinders 12 and the piston rod 14*b* of the tilt cylinder 14. It should be noted however that, in Embodiment 1, the angle of the outboard motor 300 is adjusted using only the piston rod 14*b* of the tilt cylinder 14 also in the tilt range, in some cases (these cases will be described later).

(Hydraulic Circuit)

Figure 4:
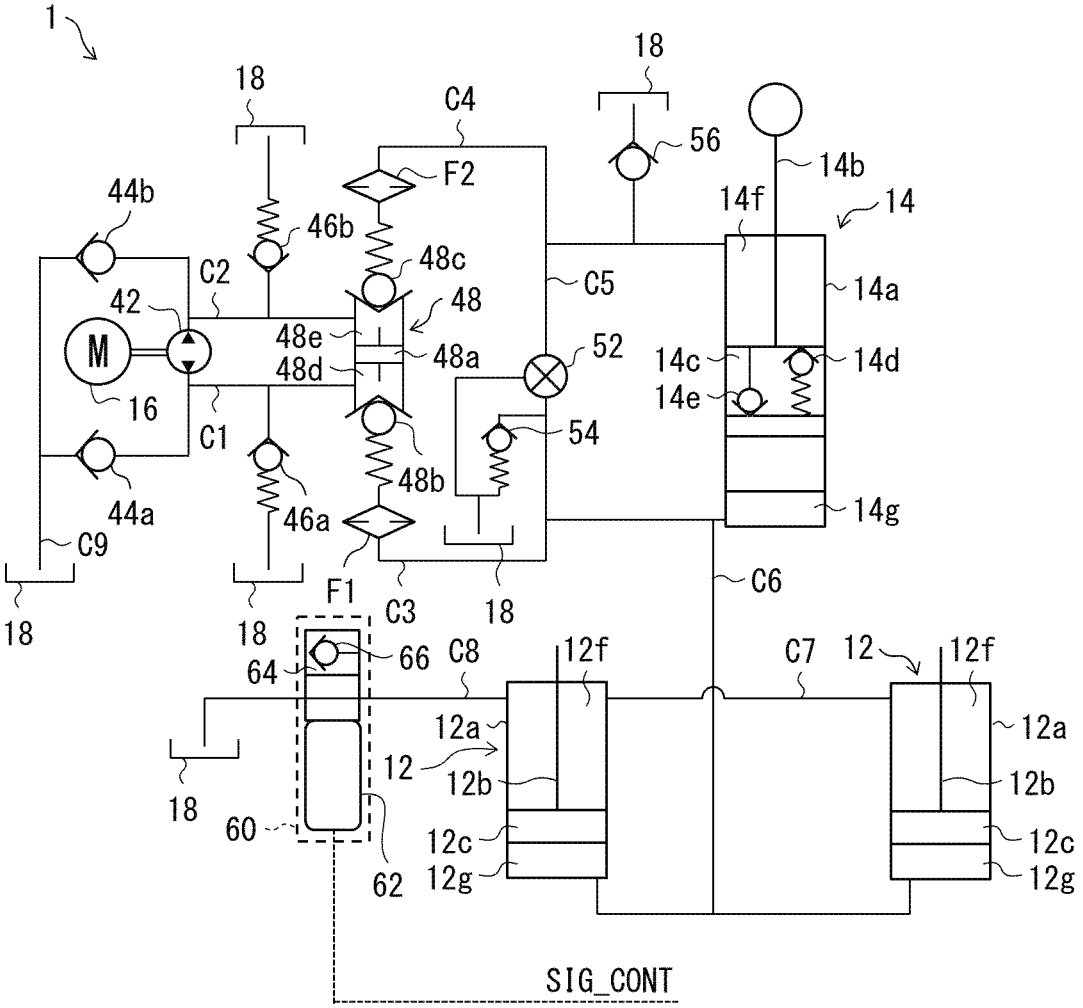
FIG. 4 illustrates a hydraulic circuit of the outboard motor raising and lowering apparatus in accordance with Embodiment 1.

The following description will discuss a hydraulic circuit of the outboard motor raising and lowering apparatus 1. FIG. 4 illustrates the hydraulic circuit of the outboard motor raising and lowering apparatus 1. In FIG. 4, the members that have already been discussed are assigned the same referential numerals.

As illustrated in FIG. 4, the outboard motor raising and lowering apparatus 1 includes: the motor 16; a pump 42; a first non-return valve 44*a*; a second non-return valve 44*b*; an up blow valve 46*a*; a down blow valve 46*b*; a main valve (pump port) 48; a manual valve 52; a thermal valve 54; the tilt cylinder 14; the trim cylinders 12; the tank 18; filters F1 and F2; and first to ninth flow passages C1 to C9.

The pump 42, which is driven by the motor 16 and which serves as a hydraulic pressure source, carries out a "forward rotation", "reverse rotation", or "stop" action in response to a UP or DOWN signal SIG_UD, which is indicative of an instruction provided by an operator to raise or lower the outboard motor. The tank 18 stores a hydraulic fluid therein.

As illustrated in FIG. 4, the main valve 48 includes a spool 48*a*, a first check valve 48*b*, and a second check valve 48*c*. The main valve 48 is partitioned by the spool 48*a* into: a first chamber 48*d* nearer the first check valve 48*b*; and a second chamber 48*e* nearer the second check valve 48*c*.

The first flow passage C1 connects the pump 42 and the first shuttle chamber 48*d*, and connects the pump 42 and the first non-return valve 44*a*. The first flow passage C1 is also connected with the up blow valve 46*a*. The second flow passage C2 connects the pump 42 and the second chamber 48*e*, and connects the pump 42 and the second non-return valve 44*b*. The second flow passage C2 is also connected with the down blow valve 46*b*.

Note that the term "connect" in fluid passage arrangements described in this specification is intended to mean either that hydraulic pressure elements are directly connected to each other by a flow passage without any other hydraulic pressure element interposed between them or that hydraulic pressure elements are indirectly connected to each other with some other hydraulic pressure element interposed between them. Examples of "other hydraulic pressure element" here include valves, cylinders, and filters.

The tilt cylinder 14 is partitioned by the piston 14*c* into an upper chamber 14*f* and a lower chamber 14*g*. The piston 14*c* of the tilt cylinder 14 includes, as illustrated in FIG. 4, a shock blow valve 14*d* and a return valve 14*e*.

Note that, in this specification, the "upper" and "lower" as in the "upper chamber" and "lower chamber" are used merely to distinguish between the chambers, and do not necessarily mean that the upper chamber is positioned higher than the lower chamber. Therefore, the "upper chamber" and "lower chamber" may be expressed as below: a cylinder is partitioned into first and second chambers by a piston; and the first chamber through which a rod connected to the piston passes is referred to as "upper chamber", and the second chamber through which the rod does not pass is referred to as "lower chamber".

In this specification, the terms "upper chamber" and "lower chamber" are used, provided that these terms do not cause any particular confusion; however, the above points should be noted.

Each of the trim cylinders 12 is partitioned by the piston 12*c* into an upper chamber 12*f* and a lower chamber 12*g*.

The first check valve 48*b* is connected to the lower chamber 14*g* of the tilt cylinder 14 via the filter F1 and the third flow passage C3. On the other hand, the second check valve 48*c* is connected to the upper chamber 14*f* of the tilt cylinder 14 via the filter F2 and the fourth flow passage C4. As illustrated in FIG. 4, the fourth flow passage C4 is connected with an upper chamber feed valve 56.

The fifth flow passage C5, which connects the third flow passage C3 and the fourth flow passage C4, has the manual valve 52 and the thermal valve 54 connected thereto.

Note that the first flow passage C1 and the third flow passage C3, which connect the pump 42 and the lower chamber 14*g* of the tilt cylinder 14 via the main valve 48 and the filter F1, may be collectively referred to as a first fluid passage.

The sixth flow passage C6 (this flow passage may also be referred to as a first fluid passage) connects the third flow passage C3 and the lower chambers 12*g* of the trim cylinders 12.

The seventh flow passage C7 (this may be referred to as a third fluid passage) connects the upper chambers 12*f* of the trim cylinders 12 to each other. Due to the presence of the seventh flow passage C7, the pressures inside the upper chambers 12*f* of the trim cylinders 12 are allowed to equilibrate.

The eighth flow passage C8 (this may be referred to as a second fluid passage) connects one of the upper chambers 12*f* of the trim cylinders 12 to the tank 18. The ninth flow passage C9 connects the first non-return valve 44*a* and the second non-return valve 44 to the tank 18.

The first non-return valve 44*a* allows supply of hydraulic fluid from the tank 18 to the pump 42 when the pump 42 still tries to take in hydraulic fluid even under the conditions in which the trim cylinders 12 and the tilt cylinder 14 have fully retracted.

The second non-return valve 44*b* allows supply of hydraulic fluid in an amount corresponding to the volume that used to be occupied by the piston rod 14*b* from the tank 18 to the pump 42 when the tilt cylinder 14 extends, and allows supply of hydraulic fluid in an amount corresponding to the volume that used to be occupied by the piston rods 12*b* from the tank 18 to the pump 42 when the trim cylinders 12 extend.

The up blow valve 46*a* allows return of excess hydraulic fluid to the tank 18 when the pump 42 still continues to deliver hydraulic fluid even under the conditions in which the trim cylinders 12 and the tilt cylinder 14 have fully extended.

The down blow valve 46*b* allows return of hydraulic fluid in an amount corresponding to the volume displaced by the piston rod 14*b* to the tank 18 when the tilt cylinder 14 retracts, and allows return of hydraulic fluid in an amount corresponding to the volume displaced by the piston rods 12*b* to the tank 18 when the trim cylinders 12 retract.

The manual valve 52 can be manually opened and closed. When the manual valve 52 is placed into its open state for maintenance of the outboard motor raising and lowering apparatus 1 or the like, hydraulic fluid returns from the lower chamber 14*g* of the tilt cylinder 14 to the tank 18. This makes it possible to manually cause the tilt cylinder 14 to retract.

The thermal valve 54 allows return of excess hydraulic fluid to the tank 18 when the volume of hydraulic fluid increases due to temperature rise.

(Switching Valve 60)

The switching valve 60 at the eighth flow passage C8 includes, as illustrated in FIG. 4: a solenoid 62; and a plunger 64 that is driven by the solenoid 62 and that serves to place the eighth flow passage C8 into a blocked state or an open state. The solenoid 62 is supplied with a control signal SIG_CONT that is indicative of an instruction by an operator to control the switching valve, and is turned on or off in accordance with the control signal SIG_CONT.

The switching valve 60 may be a normally closed valve such that: when the solenoid 62 is off, the switching valve 60 is in the closed state so that the eighth flow passage C8 is blocked; and, when the solenoid 62 is on, the switching valve 60 is in the open state so that the eighth flow passage C8 is opened. Alternatively, the switching valve 60 may be a normally open valve such that: when the solenoid is off, the switching valve 60 is in the open state so that the eighth flow passage C8 is opened; and, when the solenoid is on, the switching valve 60 is in the closed state so that the eighth flow passage C8 is blocked.

In cases where the switching valve 60 is a normally open valve, the eighth flow passage C8 is kept open (that is, the upper chambers 12*f* of the trim cylinders 12 and the tank 18 are kept in communication with each other) even if the switching valve 60 stops operating. Thus, the angle of the outboard motor 300 can be adjusted using both the tilt cylinder 14 and the trim cylinders 12.

On the other hand, in cases where the switching valve 60 is a normally closed valve, the eighth flow passage C8 is kept closed (that is, the upper chambers 12*f* of the trim cylinders 12 and the tank 18 are kept isolated from each other) even if the switching valve 60 stops operating. This prevents hydraulic fluid from overflowing from the upper chambers 12*f* of the trim cylinders 12. Thus, the angle of the outboard motor 300 can be adjusted or kept using only the tilt cylinder 14.

Note that, in Embodiment 1, the plunger 64 is provided with a valve 66 which serves to stop the flow of hydraulic fluid from the upper chambers 12*f* of the trim cylinders 12 when the eighth flow passage C8 is in the blocked state.

The above descriptions deal with an example in which the solenoid 62 is an on/off solenoid and the plunger 64 serves to place the eighth flow passage C8 into either the blocked state or the open state; however, this does not impose any limitation on Embodiment 1. The following arrangement may be employed: the solenoid 62 is a proportional solenoid; and thereby the plunger 64 can be controlled to reside at any position between a position corresponding to the blocked state and a position corresponding to the opened state. Such an arrangement makes it possible to control the flow rate of hydraulic fluid that passes through the eighth flow passage C8 in smaller steps, and thus possible to control raising and lowering of the outboard motor 300 in smaller steps.

(Examples of Action Carried Out by Outboard Motor Raising and Lowering Apparatus 1)

(Raising Action)

When the UP or DOWN signal SIG_UD is indicative of "UP", the pump 42 rotates in a forward direction, and thereby pressurized hydraulic fluid is delivered from the pump 42 to the first chamber 48*d* of the main valve 48. With this, the first check valve 48*b* opens, the spool 48*a* moves toward the first check valve 48*b*, and the second check valve 48*c* opens. It follows that the hydraulic fluid is supplied to the lower chamber 14*g* of the tilt cylinder 14 and that the hydraulic fluid is withdrawn from the upper chamber 14*f* of the tilt cylinder 14.

In the above case, when the switching valve 60 is in the open state, the hydraulic fluid is supplied also to the lower chambers 12*g* of the trim cylinders 12, and thereby both the piston rod 14*b* of the tilt cylinder 14 and the piston rods 12*b* of the trim cylinders 12 ascend.

On the other hand, when the switching valve 60 is in the closed state, the hydraulic fluid is not supplied to the lower chambers 12*g* of the trim cylinders 12. Therefore, although the piston rod 14*b* of the tilt cylinder 14 ascends, the piston rods 12*b* of the trim cylinders 12 do not ascend.

When the switching valve 60 is in the closed state, the hydraulic fluid is not supplied to the lower chambers 12*g* of the trim cylinders 12. The amount of hydraulic fluid delivered by the pump 42 per unit time is not significantly different between when the switching valve 60 is in the open state and when the switching valve 60 is in the closed state. Thus, the piston rod 14*b* of the tilt cylinder 14 ascends more quickly than when the switching valve 60 is in the open state.

(Lowering Action) When the UP or DOWN signal SIG_UD is indicative of "DOWN", the pump 42 rotates in a reverse direction, and thereby pressurized hydraulic fluid is delivered from the pump 42 to the second chamber 48*e* of the main valve 48. With this, the second check valve 48*c* opens, the spool 48*a* moves toward the second check valve 48*c*, and the first check valve 48*b* opens. It follows that the hydraulic fluid is supplied to the upper chamber 14*f* of the tilt cylinder 14 and that the hydraulic fluid is withdrawn from the lower chamber 14*g* of the tilt cylinder 14.

In the above case, when the switching valve 60 is in the open state, the hydraulic fluid is withdrawn also from the lower chambers 12*g* of the trim cylinders 12, and thereby both the piston rod 14*b* of the tilt cylinder 14 and the piston rods 12*b* of the trim cylinders 12 descend.

On the other hand, when the switching valve 60 is in the closed state, the hydraulic fluid is not withdrawn from the lower chambers 12*g* of the trim cylinders 12. Therefore, although the piston rod 14*b* of the tilt cylinder 14 descends, the piston rods 12*b* of the trim cylinders 12 do not descend.

When the switching valve 60 is in the closed state, the hydraulic fluid is not withdrawn from the lower chambers 12*g* of the trim cylinders 12. Thus, the piston rod 14*b* of the tilt cylinder 14 descends more quickly than when the switching valve 60 is in the open state.

(Hold State)

When the UP or DOWN signal SIG_UD is indicative of neither "UP" nor "DOWN", the pump 42 stops. The stoppage of the pump 42 results in holding of the outboard motor 300 by the outboard motor raising and lowering apparatus 1, in which the flow of hydraulic fluid within the hydraulic circuit of the outboard motor raising and lowering apparatus 1 has spontaneously ceased. Note that, in this specification, the case in which the UP or DOWN signal SIG_UD is indicative of neither "UP" nor "DOWN" may be referred to as "the UP or DOWN signal SIG_UD is indicative of 'HOLD'", for convenience of description.

As has been described, the outboard motor raising and lowering apparatus 1 includes the switching valve 60, and is thereby capable of suitably changing the speed of raising/lowering of the outboard motor 300.

<Effect Obtained when Switching Valve 60 is Located at Eighth Flow Passage>

As described earlier, in Embodiment 1, the switching valve 60 is provided at the eighth flow passage C8 connected to the upper chambers (first chambers) 12*f* of the trim cylinders 12. On the other hand, one comparative example would be an arrangement in which the switching valve 60 is provided at the sixth flow passage C6 connected to the lower chambers 12*g* of the trim cylinders 12.

However, generally, a lower chamber of a cylinder experiences higher hydraulic pressure than an upper chamber, and the value of the hydraulic pressure experienced by the lower chamber reaches, for example, about 25 MPa. Therefore, in cases where the switching valve 60 is provided at the sixth flow passage C6 connected to the lower chambers 12*g* of the trim cylinders 12, the switching valve 60 is required to be highly pressure resistant and have high sealing performance. This leads to increases in size and weight of the switching valve 60.

Furthermore, in cases where the switching valve 60 is provided at the sixth flow passage C6, if the switching valve 60 is a normally closed valve and the piston rods 12*b* receive an external force, the switching valve 60 may receive excessive pressure. To address this, it is necessary to separately provide a protective valve that serves to allow the excessive pressure to escape.

In contrast, in an arrangement in which the switching valve 60 is provided at the eighth low passage C8 connected to the upper chambers (first chambers) 12*f* of the trim cylinders 12 like Embodiment 1, the switching valve 60 is not required to be highly pressure resistant and have high sealing performance, unlike the above arrangement. Furthermore, in an arrangement in which the switching valve 60 is provided at the eighth low passage C8, the foregoing protective valve is not essential.

As such, an arrangement in which the switching valve 60 is provided at the eighth flow passage C8 connected to the upper chambers (first chambers) 12*f* of the trim cylinders 12, like Embodiment 1, is advantageous in that this arrangement can reduce the size and weight of the outboard motor raising and lowering apparatus as compared to an arrangement in which the switching valve 60 is provided at the sixth flow passage C6 connected to the lower chambers 12*g* of the trim cylinders 12. The above arrangement is also advantageous in that production cost is reduced and reliability improves.

Embodiment 2

Figure 5:
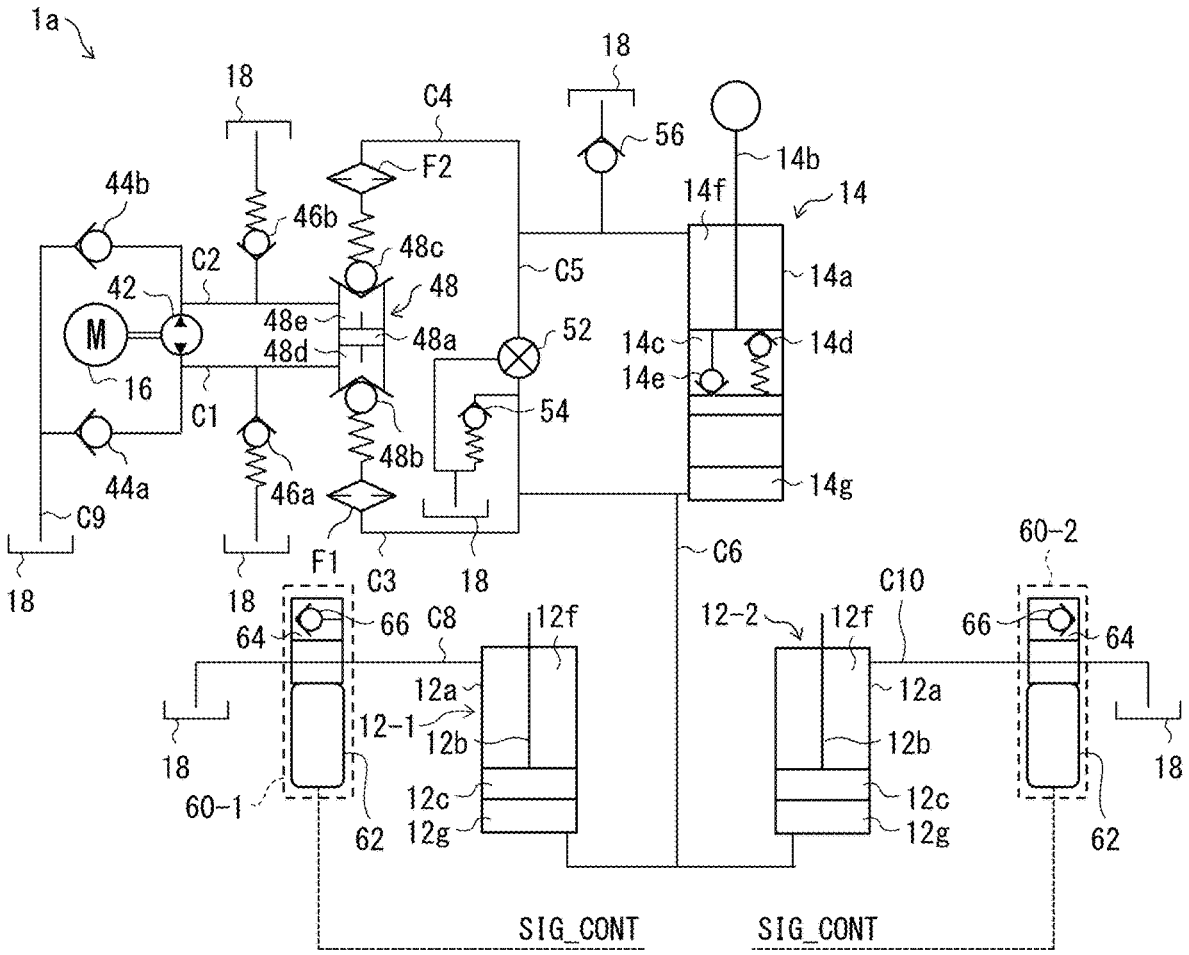
FIG. 5 illustrates a hydraulic circuit of an outboard motor raising and lowering apparatus in accordance with Embodiment 2.

The following description will discuss a configuration of an outboard motor raising and lowering apparatus 1*a* in accordance with Embodiment 2, with reference to FIG. 5. FIG. 5 illustrates a hydraulic circuit of the outboard motor raising and lowering apparatus 1*a* in accordance with Embodiment 2. In FIG. 5, the members that have already been discussed are assigned the same referential numerals.

As illustrated in FIG. 5, the outboard motor raising and lowering apparatus 1*a* in accordance with Embodiment 2 includes two trim cylinders 12-1 and 12-2, and upper chambers of these trim cylinders are connected with switching valves 60-1 and 60-2, respectively. In other words, the outboard motor raising and lowering apparatus 1*a* in accordance with Embodiment 2 includes the first switching valve 60-1, which is connected to the upper chamber (first chamber) 12*f* of the first trim cylinder 12-1, and the second switching valve 60-2, which is connected to the upper chamber (first chamber) 12*f* of the second trim cylinder 12-2.

Note, here, that the first trim cylinder 12-1 and the second trim cylinder 12-2 are the same in configuration as the trim cylinders 12 discussed in Embodiment 1, and the first switching valve 60-1 and the second switching valve 60-2 are the same in configuration as the switching valve 60 discussed in Embodiment 1.

As illustrated in FIG. 5, the outboard motor raising and lowering apparatus 1*a* in accordance with Embodiment 2 includes a tenth flow passage C10 that is connected to the upper chamber 12*f* of the second trim cylinder 12-2. The first switching valve 60-1 is provided at the eighth flow passage C8 connected to the upper chamber 12*f* of the first trim cylinder 12-1, and the second switching valve 60-2 is provided at the tenth flow passage C10.

The outboard motor raising and lowering apparatus 1 in accordance with Embodiment 2 does not include a fluid passage that connects the upper chamber 12*f* of the first trim cylinder 12-1 and the upper chamber 12*f* of the second trim cylinder 12-2 to each other.

An arrangement like that described above also makes it possible to provide similar effects to those provided by the outboard motor raising and lowering apparatus discussed in Embodiment 1.

Furthermore, an arrangement like that described above makes it possible to separately control, with the use of the first switching valve 60-1 and the second switching valve 60-2, the flow of hydraulic fluid from the upper chamber 12*f* of the first trim cylinder 12-1 and the flow of hydraulic fluid from the upper chamber 12*f* of the second trim cylinder 12-2; therefore, such an arrangement makes it possible to control the raising and lowering of the outboard motor in smaller steps.

Note that, although the above description deals with an example in which the outboard motor raising and lowering apparatus 1*a* includes two trim cylinders 12, Embodiment 2 is not limited as such. For example, an arrangement in which the outboard motor raising and lowering apparatus 1*a* includes three or more trim cylinders 12 and in which switching valves 60 are connected to the respective upper chambers 12*f* of the three or more trim cylinders 12 is also encompassed in Embodiment 2.

Embodiment 3

Figure 6:
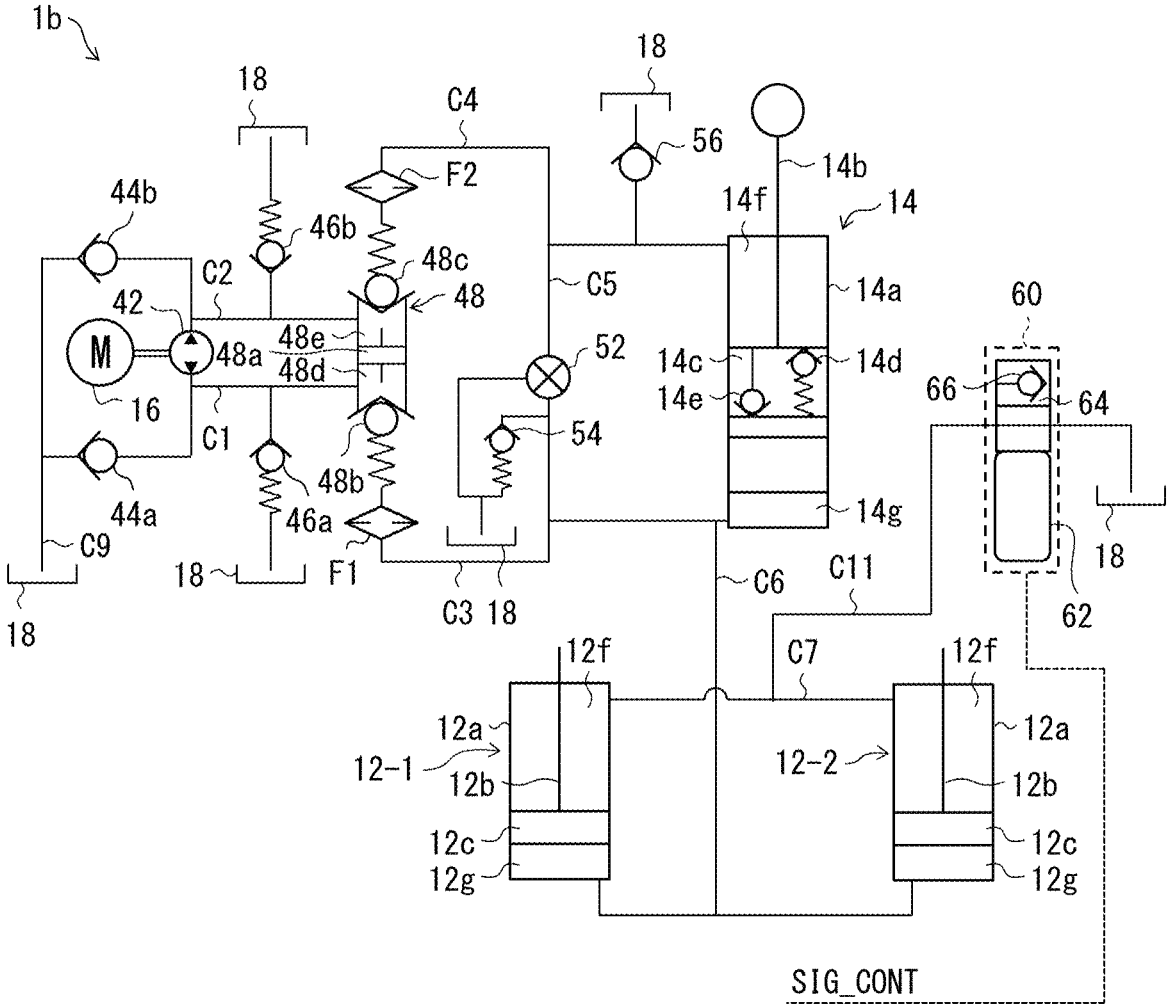
FIG. 6 illustrates a hydraulic circuit of an outboard motor raising and lowering apparatus in accordance with Embodiment 3.

The following description will discuss a configuration of an outboard motor raising and lowering apparatus 1*b* in accordance with Embodiment 3, with reference to FIG. 6. FIG. 6 illustrates a hydraulic circuit of the outboard motor raising and lowering apparatus 1*b* in accordance with Embodiment 3. In FIG. 6, the members that have already been discussed are assigned the same referential numerals.

As illustrated in FIG. 6, the outboard motor raising and lowering apparatus 1*b* in accordance with Embodiment 3 includes a first trim cylinder 12-1 and a second trim cylinder 12-2, and a switching valve 60 is directly connected to upper chambers (first chambers) 12*f* of the first trim cylinder 12-1 and the second trim cylinder 12-2. More specifically, the outboard motor raising and lowering apparatus 1*b* in accordance with Embodiment 3 includes an eleventh flow passage C11 that is connected to the seventh flow passage C7, and the upper chamber 12*f* of the first trim cylinder 12-1, the upper chamber 12*f* of the second trim cylinder 12-2, and the switching valve 60 are directly connected to each other by the seventh flow passage C7 and the eleventh flow passage C11.

Note, here, that the first trim cylinder 12-1 and the second trim cylinder 12-2 are the same in configuration as the trim cylinders 12 discussed in Embodiment 1, and the first switching valve 60-1 and the second switching valve 60-2 are the same in configuration as the switching valve 60 discussed in Embodiment 1.

An arrangement like that described above also makes it possible to provide similar effects to those provided by the outboard motor raising and lowering apparatus discussed in Embodiment 1.

Embodiment 4

Figure 7:
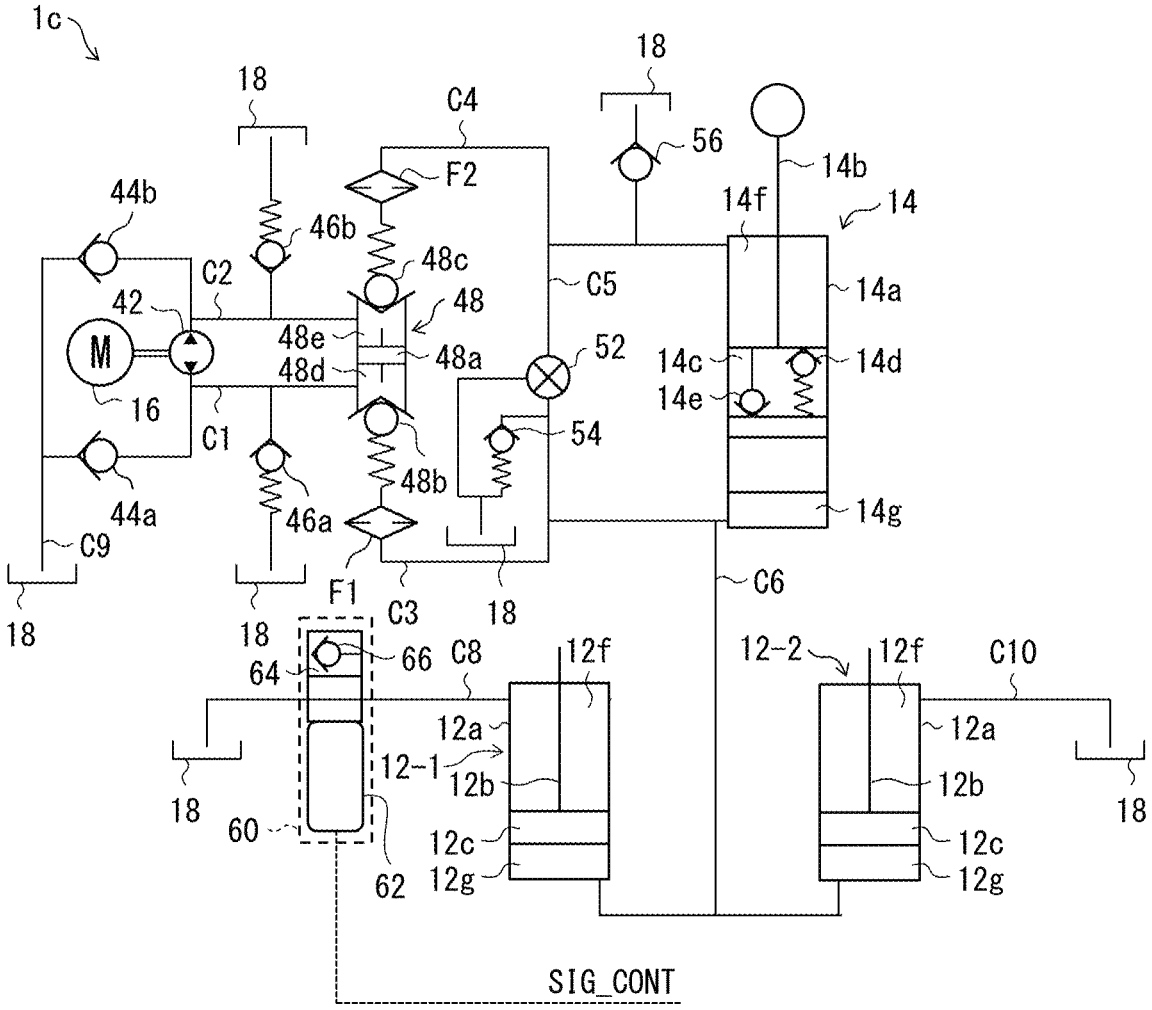
FIG. 7 illustrates a hydraulic circuit of an outboard motor raising and lowering apparatus in accordance with Embodiment 4.

The following description will discuss a configuration of an outboard motor raising and lowering apparatus 1*c* in accordance with Embodiment 4, with reference to FIG. 7. FIG. 7 illustrates a hydraulic circuit of the outboard motor raising and lowering apparatus 1*c* in accordance with Embodiment 4. In FIG. 7, the members that have already been discussed are assigned the same referential numerals.

As illustrated in FIG. 7, the outboard motor raising and lowering apparatus 1*c* in accordance with Embodiment 4 includes a first trim cylinder 12-1 and a second trim cylinder 12-2, and a switching valve 60 is connected to an upper chamber 12*f* of the first trim cylinder 12-1, which is one of the first and second trim cylinders 12-1 and 12-2. More specifically, the upper chamber 12*f* of the first trim cylinder 12-1 is connected with the eighth flow passage C8 that has one end connected to the tank 18, and the switching valve 60 is provided at the eighth flow passage C8. On the other hand, the outboard motor raising and lowering apparatus 1*c* in accordance with Embodiment 4 includes the tenth flow passage C10 that has one end connected to the tank 18, and an upper chamber 12*f* of the second trim cylinder 12-2 is connected with the other end of the tenth flow passage C10; however, the tenth flow passage C10 is provided with no switching valve 60.

Note, here, that the first trim cylinder 12-1 and the second trim cylinder 12-2 are the same in configuration as the trim cylinders 12 discussed in Embodiment 1.

The outboard motor raising and lowering apparatus 1*c* in accordance with Embodiment 4 does not include a flow passage that connects the upper chamber 12*f* of the first trim cylinder 12-1 and the upper chamber 12*f* of the second trim cylinder 12-2. This makes it possible for the outboard motor raising and lowering apparatus 1*c* in accordance with Embodiment 4 to control only the first trim cylinder 12-1 with the use of the switching valve 60.

According to the above arrangement, when the switching valve 60 is in the closed state, hydraulic fluid neither flows out of nor flows into the upper chamber 12*f* of the first trim cylinder 12-1. This makes it possible to raise/lower the outboard motor 300 with the use of only the tilt cylinder 14 and the second trim cylinder 12-2.

As such, by placing the switching valve 60 in the closed state, it is possible to more quickly raise/lower the outboard motor 300 as compared to when the switching valve 60 is in the open state.

The above description deals with an example in which the switching valve 60 is connected to only the upper chamber 12*f* of the first trim cylinder 12-1, which is one of the first and second trim cylinders 12-1 and 12-2; however, Embodiment 4 is not limited as such. For example, an arrangement in which N (N is three or more) trim cylinders 12 are provided and in which the switching valve 60 is connected to at least one of the upper chambers 12*f* of these N trim cylinders 12 is also encompassed in Embodiment 4.

Embodiment 5

Figure 8:
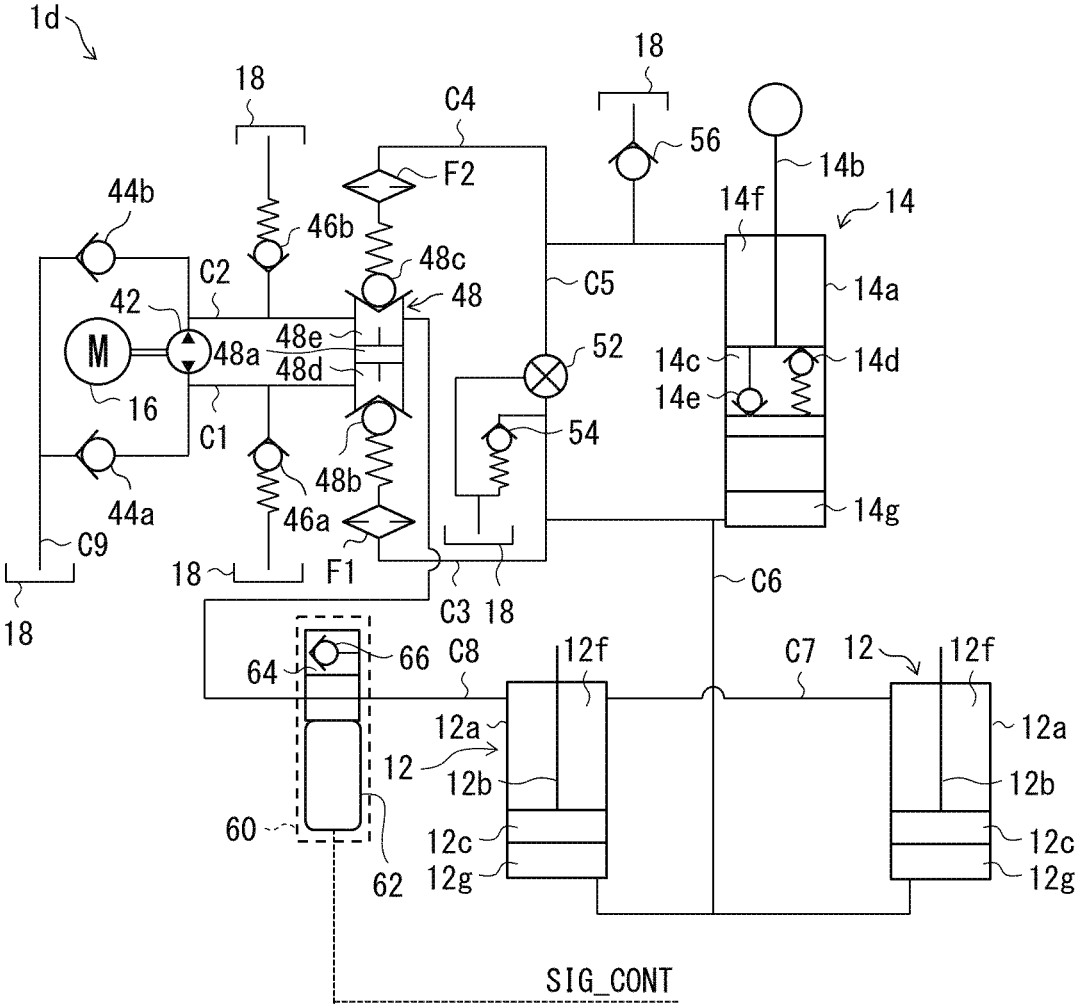
FIG. 8 illustrates a hydraulic circuit of an outboard motor raising and lowering apparatus in accordance with Embodiment 5.

The following description will discuss a configuration of an outboard motor raising and lowering apparatus 1*d* in accordance with Embodiment 5, with reference to FIG. 8. FIG. 8 illustrates a hydraulic circuit of the outboard motor raising and lowering apparatus 1*d* in accordance with Embodiment 5. In FIG. 8, the members that have already been discussed are assigned the same referential numerals.

As illustrated in FIG. 8, in the outboard motor raising and lowering apparatus 1*d* in accordance with Embodiment 5, the eighth flow passage C8 is connected, via a switching valve 60, to the second chamber 48*e*, which is one of the first and second chambers 48*d* and 48*e* of the main valve 48. Note here that the second chamber 48*e* is connected to the upper chamber (first chamber) of the tilt cylinder 14 by the fourth flow passage C4 via the second check valve 48*c* and the filter F2. As such, in Embodiment 5, the eighth flow passage C8 is connected, via the switching valve 60, to the second chamber 48*e*, which is connected to the first chamber of the tilt cylinder 14 and which is one of the first and second chambers 48*d* and 48*e*.

An arrangement like that described above also makes it possible to provide similar effects to those provided by the outboard motor raising and lowering apparatus discussed in Embodiment 1. Furthermore, since the eighth flow passage C8 does not need to be extended to reach the tank 18, it is possible to simplify the fluid passage arrangement, depending on how the constituent elements of the outboard motor raising and lowering apparatus 1*d* are arranged. Furthermore, as compared to an arrangement in which the eighth flow passage C8 is connected to the fourth flow passage C4 like Embodiment 6 (described later), it is possible to make the eighth flow passage C8 insusceptible to the influence of fluctuations of hydraulic pressure in the upper chamber 14*f* of the tilt cylinder 14.

Embodiment 6

Figure 9:
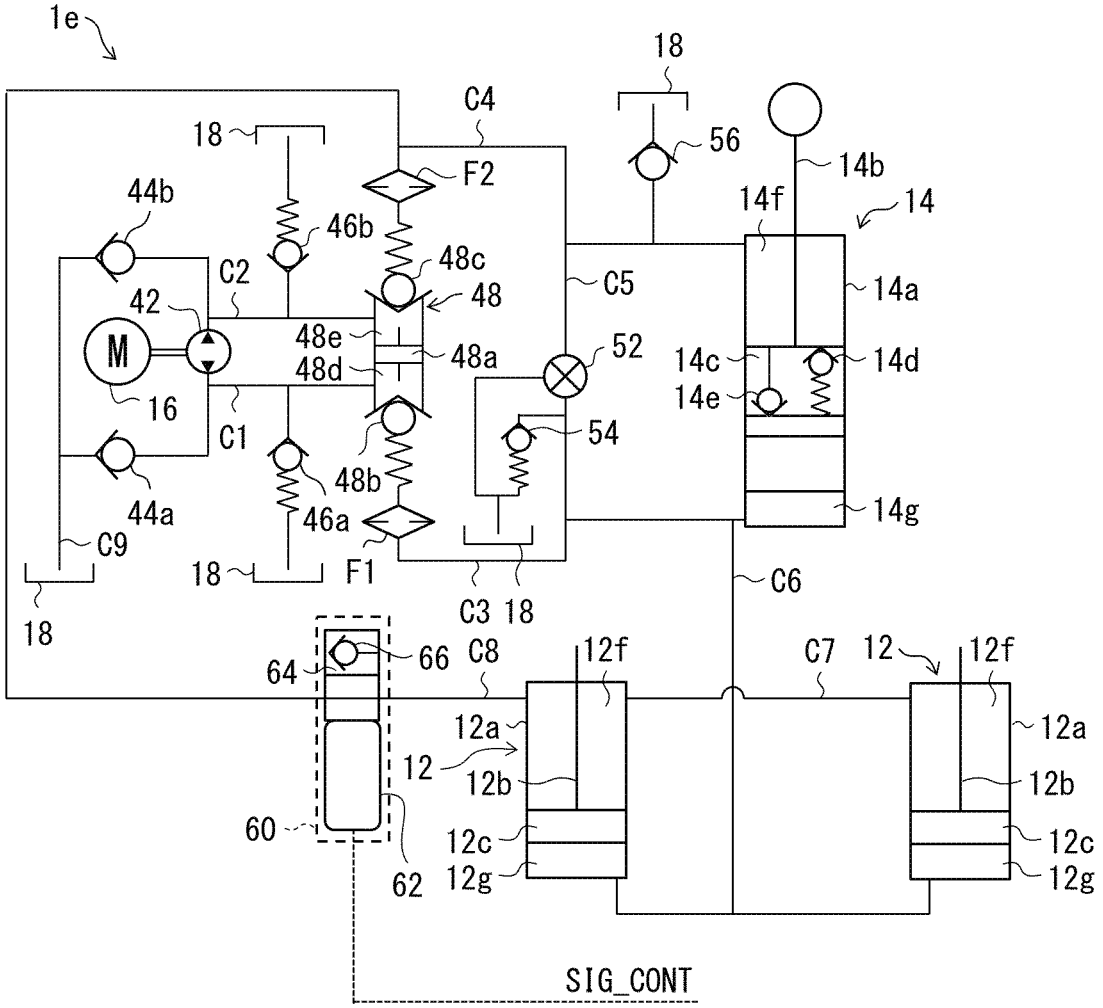
FIG. 9 illustrates a hydraulic circuit of an outboard motor raising and lowering apparatus in accordance with Embodiment 6.

The following description will discuss a configuration of an outboard motor raising and lowering apparatus 1*e* in accordance with Embodiment 6, with reference to FIG. 9. FIG. 9 illustrates a hydraulic circuit of the outboard motor raising and lowering apparatus 1*e* in accordance with Embodiment 6. In FIG. 9, the members that have already been discussed are assigned the same referential numerals.

As illustrated in FIG. 9, in the outboard motor raising and lowering apparatus 1*e* in accordance with Embodiment 6, the eighth flow passage C8 is connected to the fourth flow passage C4 via the switching valve 60. Note here that the fourth flow passage C4 is connected to the upper chamber (first chamber) of the tilt cylinder 14. That is, in Embodiment 6, the eighth flow passage C8 is connected to the upper chamber (first chamber) of the tilt cylinder 14 via the switching valve 60.

An arrangement like that described above also makes it possible to provide similar effects to those provided by the outboard motor raising and lowering apparatus discussed in Embodiment 1. Furthermore, since the eighth flow passage C8 does not need to be extended to reach the tank 18, it is possible to simplify the fluid passage arrangement, depending on how the constituent elements of the outboard motor raising and lowering apparatus 1*d* are arranged. Furthermore, as compared to Embodiment 5 in which the eighth flow passage C8 is connected to the main valve 48, process cost can be reduced.

Embodiment 7

Figure 10:
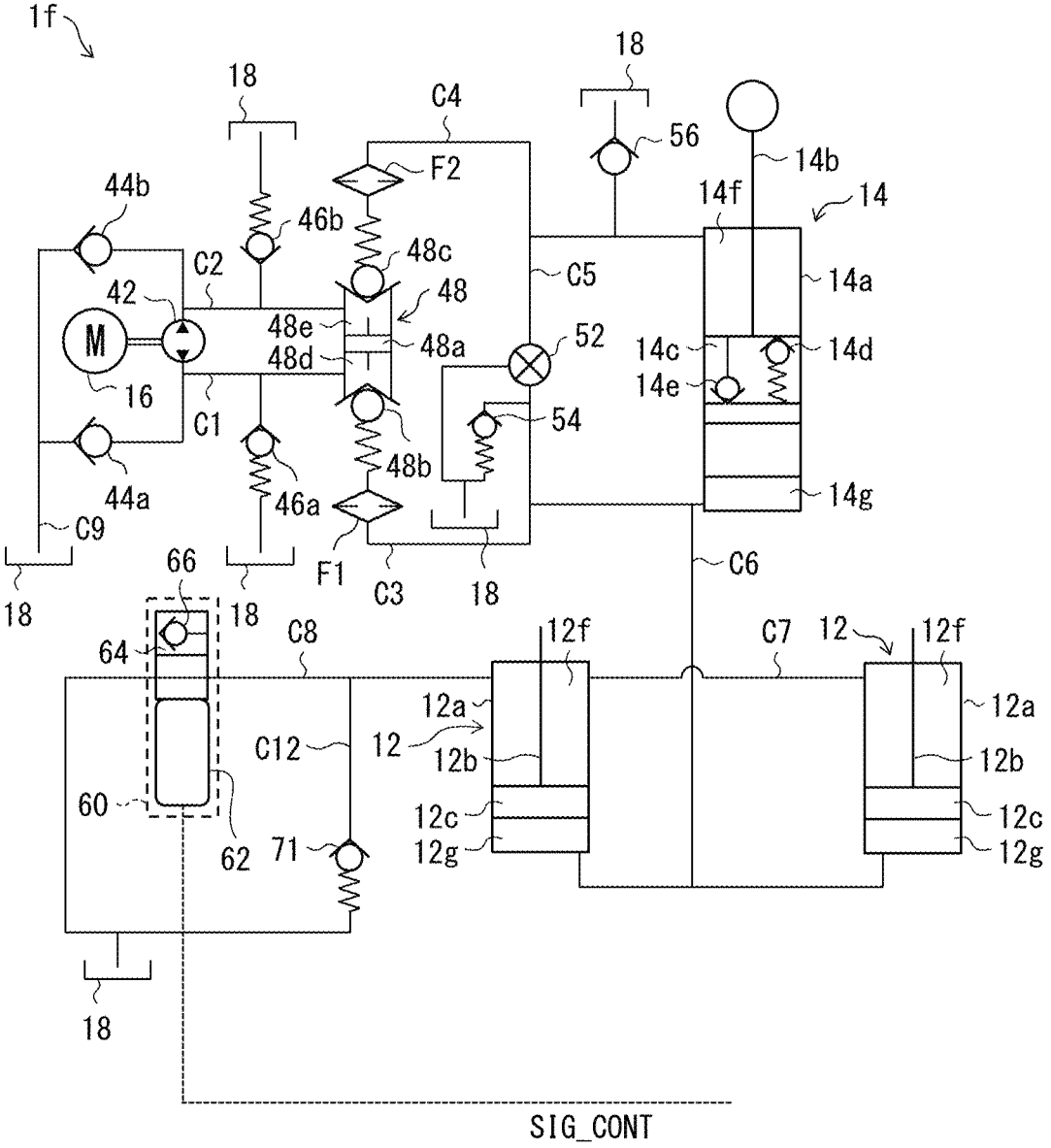
FIG. 10 illustrates a hydraulic circuit of an outboard motor raising and lowering apparatus in accordance with Embodiment 7.

The following description will discuss a configuration of an outboard motor raising and lowering apparatus if in accordance with Embodiment 7, with reference to FIG. 10. FIG. 10 illustrates a hydraulic circuit of the outboard motor raising and lowering apparatus if in accordance with Embodiment 7. In FIG. 10, the members that have already been discussed are assigned the same referential numerals.

As illustrated in FIG. 10, the outboard motor raising and lowering apparatus if in accordance with Embodiment 7 includes a twelfth flow passage C12 that is connected to the eighth flow passage C8. Furthermore, in the outboard motor raising and lowering apparatus if in accordance with Embodiment 7, one end of a protective valve 71 is connected by the twelfth flow passage C12 to the eighth flow passage C8 at a point between a switching valve 60 and a trim cylinder 12. The other end of the protective valve 71 is connected to the tank 18.

According to the outboard motor raising and lowering apparatus 1*f* in accordance with Embodiment 7, even if the hydraulic pressure in the upper chambers 12*f* of the trim cylinders 12 has become too high, excess hydraulic pressure is released via the protective valve 71. This makes it possible to reduce the likelihood that excessive hydraulic pressure will be applied to the switching valve 60, while providing similar effects to those provided by Embodiment 1.

Note that the protective valve 71 included in the outboard motor raising and lowering apparatus in accordance with Embodiment 7 is not limited for use in the fluid passage arrangement illustrated in FIG. 10. For example, also each of the outboard motor raising and lowering apparatuses illustrated in FIGS. 5 to 9 and FIGS. 11 and 12 (described later) may be arranged such that one end of the protective valve 71 is connected by the twelfth flow passage C12 to the eighth flow passage C8 at a point between the switching valve 60 and the trim cylinder 12 (12-1), in a similar manner.

Embodiment 8

Figure 11:
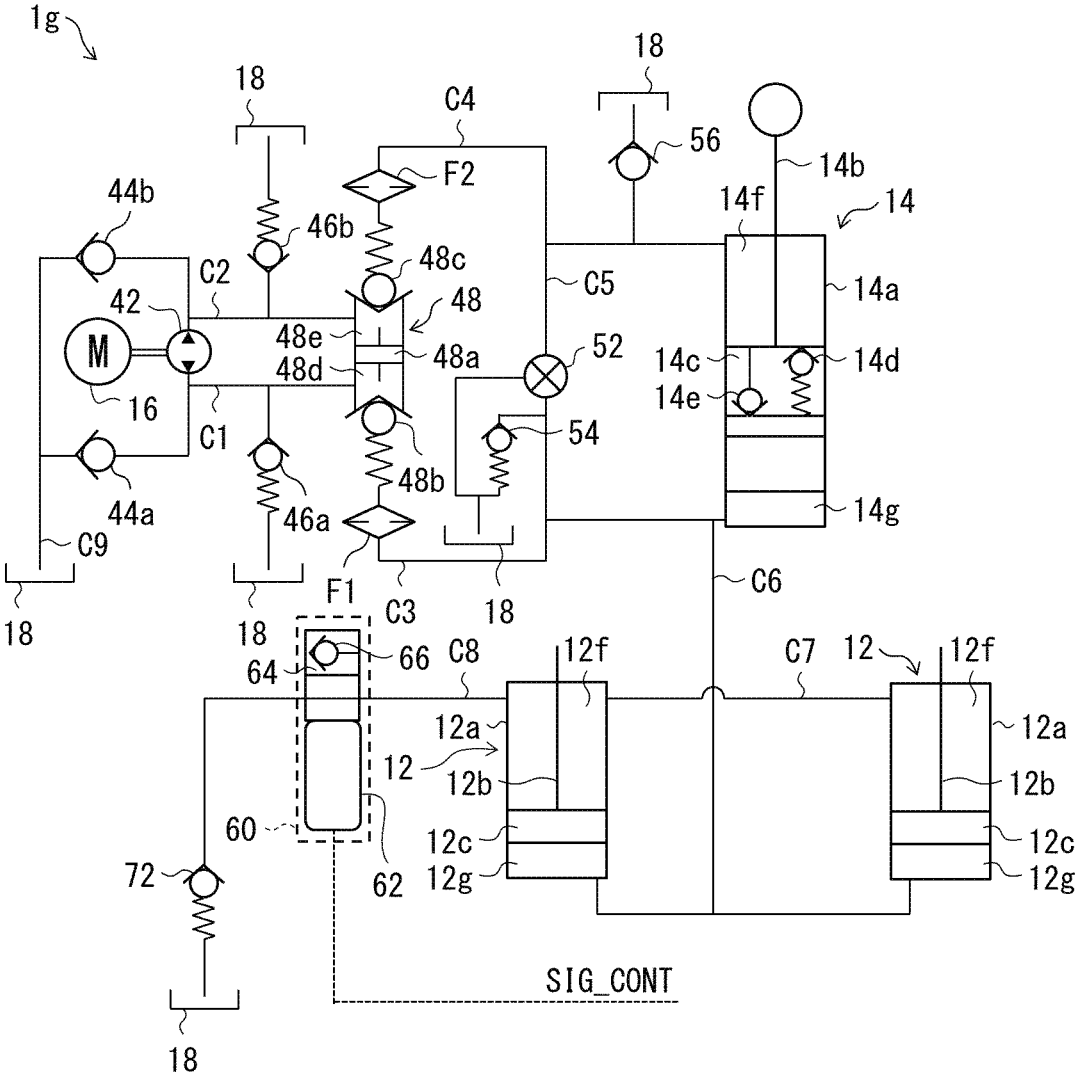
FIG. 11 illustrates a hydraulic circuit of an outboard motor raising and lowering apparatus in accordance with Embodiment 8.

The following description will discuss a configuration of an outboard motor raising and lowering apparatus 1*g* in accordance with Embodiment 8, with reference to FIG. 11. FIG. 11 illustrates a hydraulic circuit of the outboard motor raising and lowering apparatus 1*g* in accordance with Embodiment 8. In FIG. 11, the members that have already been discussed are assigned the same referential numerals.

As illustrated in FIG. 11, in the outboard motor raising and lowering apparatus 1*g* in accordance with Embodiment 8, the eighth flow passage C8 is connected to the tank 18 via the switching valve 60, and the eighth flow passage C8 is provided with a protective valve (holding valve) 72 that resides between the switching valve 60 and the tank 18.

The above-described arrangement of the outboard motor raising and lowering apparatus 1*g* in accordance with Embodiment 8 is preferred in cases where the switching valve 60 is a normally open valve. Since the eighth flow passage C8 is provided with the protective valve 72 that resides between the switching valve 60 and the tank 18, even if the switching valve 60 stops operating, the flow of hydraulic fluid into the upper chambers 12*f* of the trim cylinders 12 is prevented or reduced. This makes it possible to eliminate or reduce the likelihood that the outboard motor 300 will lower unintentionally.

Note that the protective valve 72 included in the outboard motor raising and lowering apparatus in accordance with Embodiment 8 is not limited for use in the fluid passage arrangement illustrated in FIG. 11. For example, also each of the outboard motor raising and lowering apparatuses illustrated in FIGS. 5 to 7, FIG. 10, and FIG. 12 (described later) may be arranged such that the eighth flow passage C8 is provided with the protective valve (holding valve) 72 that resides between the switching valve 60 and the tank 18, in a similar manner.

Embodiment 9

Figure 12:
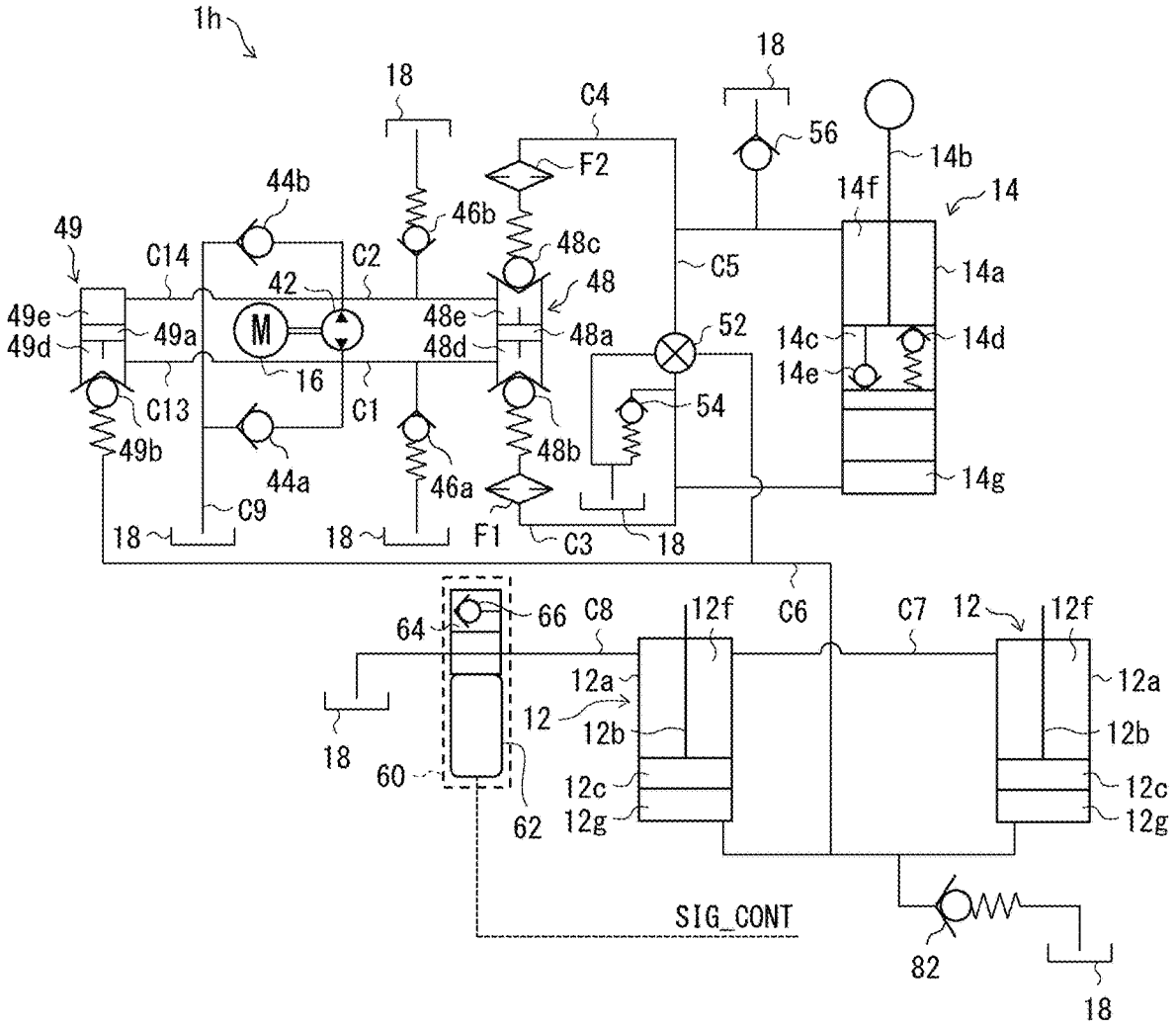
FIG. 12 illustrates a hydraulic circuit of an outboard motor raising and lowering apparatus in accordance with Embodiment 9.

The following description will discuss a configuration of an outboard motor raising and lowering apparatus 1*h* in accordance with Embodiment 9, with reference to FIG. 12. FIG. 12 illustrates a hydraulic circuit of the outboard motor raising and lowering apparatus 1*h* in accordance with Embodiment 9. In FIG. 12, the members that have already been discussed are assigned the same referential numerals.

As illustrated in FIG. 12, the outboard motor raising and lowering apparatus 1*h* in accordance with Embodiment 9 includes a second main valve (second pump port) 49 that is connected to the pump (hydraulic pressure source) 42, in addition to the main valve (first pump port) 48 that is connected to the pump 42. The outboard motor raising and lowering apparatus 1*h* in accordance with Embodiment 9 further includes a thirteenth flow passage C13 and a fourteenth flow passage C14 which connect the pump 42 and the second main valve 49.

As illustrated in FIG. 12, the second main valve 49 includes a spool 49*a* and a check valve 49*b*. The second main valve 49 is partitioned by the spool 49*a* into: a first chamber 49*d* that resides on the same side of the spool 49*a* as the check valve 49*b*; and a second chamber 49*e* that resides on the opposite side of the spool 49*a* from the check valve 49*b*.

The first chamber 49*d* of the second main valve 49 is also connected to the first chamber 48*d* of the main valve 48 by the thirteenth flow passage C13 and the first flow passage C1. The second chamber 49*e* of the second main valve 49 is also connected to the second chamber 48*e* of the main valve 48 by the fourteenth flow passage C14 and the second flow passage.

Furthermore, as illustrated in FIG. 12, in the outboard motor raising and lowering apparatus 1*h* in accordance with Embodiment 9, the sixth flow passage C6, which is connected to the lower chambers 12*g* of the trim cylinders 12, is connected to the check valve 49*b* of the second main valve 49. In other words, the sixth flow passage C6 is connected to the first shuttle chamber 49*d* of the second main valve 49 via the check valve 49.

Furthermore, as illustrated in FIG. 12, in the outboard motor raising and lowering apparatus 1*h* in accordance with Embodiment 9, the sixth flow passage C6 is also connected to the manual valve 52. Moreover, as illustrated in FIG. 12, the sixth flow passage C6 is connected with a protective valve 82, and the sixth flow passage C6 is connected to the tank 18 via the protective valve 82.

The outboard motor raising and lowering apparatus 1*h* arranged as described above operates in the following manner.

(Raising Action)

When the pump 42 rotates in a forward direction, pressurized hydraulic fluid is delivered from the pump 42 to the first chamber 48*d* of the main valve 48 and to the first chamber 49*d* of the second main valve 49. With this, the first check valve 48*b* of the main valve 48 opens, the spool 48*a* moves toward the first check valve 48*b*, and the second check valve 48*c* opens. The check valve 49*b* of the second main valve 49 also opens. It follows that hydraulic fluid is supplied from the main valve 48 to the lower chamber 14*g* of the tilt cylinder 14 and that hydraulic fluid is withdrawn from the upper chamber 14*f* of the tilt cylinder 14. Also, hydraulic fluid is supplied from the second main valve 49 to the lower chambers 12*g* of the trim cylinders 12.

In the above case, when the switching valve 60 is in the open state, the hydraulic fluid is supplied also to the lower chambers 12*g* of the trim cylinders 12, and thereby both the piston rod 14*b* of the tilt cylinder 14 and the piston rods 12*b* of the trim cylinders 12 ascend, in the same manner as the foregoing Embodiment.

On the other hand, when the switching valve 60 is in the closed state, the hydraulic fluid is not supplied to the lower chambers 12*g* of the trim cylinders 12. Therefore, although the piston rod 14*b* of the tilt cylinder 14 ascends, the piston rods 12*b* of the trim cylinders 12 do not ascend, in the same manner as the foregoing Embodiment.

When the switching valve 60 is in the closed state, the hydraulic fluid is not supplied to the lower chambers 12*g* of the trim cylinders 12. The amount of hydraulic fluid delivered by the pump 42 per unit time is not significantly different between when the switching valve 60 is in the open state and when the switching valve 60 is in the closed state. Thus, the piston rod 14*b* of the tilt cylinder 14 ascends more quickly than when the switching valve 60 is in the open state, in the same manner as the foregoing Embodiment.

(Lowering Action)

When the pump 42 rotates in a reverse direction, pressurized hydraulic fluid is delivered from the pump 42 to the second chamber 48*e* of the main valve 48 and to the second chamber 49*e* of the second main valve 49. With this, the second check valve 48*c* opens, the spool 48*a* moves toward the second check valve 48*c*, and the first check valve 48*b* opens. Furthermore, the spool 49*a* of the second main valve 49 moves toward the check valve 49*b*, and the check valve 49*b* opens. It follows that hydraulic fluid is supplied to the upper chamber 14*f* of the tilt cylinder 14 and that hydraulic fluid is withdrawn from the lower chamber 14*g* of the tilt cylinder 14. Also, hydraulic fluid is withdrawn from the lower chambers 12*g* of the trim cylinders 12.

In the above case, when the switching valve 60 is in the open state, the hydraulic fluid is withdrawn also from the lower chambers 12*g* of the trim cylinders 12, and thereby both the piston rod 14*b* of the tilt cylinder 14 and the piston rods 12*b* of the trim cylinders 12 descend, in the same manner as the foregoing Embodiment.

On the other hand, when the switching valve 60 is in the closed state, the hydraulic fluid is not withdrawn from the lower chambers 12*g* of the trim cylinders 12. Therefore, although the piston rod 14*b* of the tilt cylinder 14 descends, the piston rods 12*b* of the trim cylinders 12 do not descend, in the same manner as the foregoing Embodiment.

When the switching valve 60 is in the closed state, the hydraulic fluid is not withdrawn from the lower chambers 12*g* of the trim cylinders 12. Thus, the piston rod 14*b* of the tilt cylinder 14 descends more quickly than when the switching valve 60 is in the open state, in the same manner as the foregoing Embodiment.

Note that the second main valve 49 of the outboard motor raising and lowering apparatus 1*h* in accordance with Embodiment 9 and how the sixth flow passage C6 is connected in the outboard motor raising and lowering apparatus 1*h* in accordance with Embodiment 9 are not limited for application in the fluid passage arrangement illustrated in FIG. 12. For example, also each of the outboard motor raising and lowering apparatuses illustrated in FIGS. 5 to 11 may be similarly arranged such that the second main valve 49 is included and the sixth flow passage C6 is connected in a similar manner to that illustrated in FIG. 12.

The present invention is not limited to the embodiments, but can be altered by a skilled person in the art within the scope of the claims. The present invention also encompasses, in its technical scope, any embodiment derived by combining technical means disclosed in differing embodiments.

REFERENCE SIGNS LIST

1, 1*a*, 1*b*, 1*c*, 1*d*, 1*e*, 1*f*, 1*g*, 1*h* outboard motor raising and lowering apparatus
12, 12-1, 12-2 trim cylinder
14 tilt cylinder
42 pump (hydraulic pressure source)
60, 60-1, 60-2 switching valve
200 hull (main part)
300 outboard motor
301 engine
302 power transmission mechanism
303 propeller
310 generator
C1 first flow passage (first fluid passage)
C2 second flow passage
C3 third flow passage (first fluid passage)
C4 fourth flow passage
C5 fifth flow passage
C6 sixth flow passage (first fluid passage)
C7 seventh flow passage (third fluid passage)
C8 eighth flow passage (second fluid passage)
C9 ninth flow passage
C10 tenth flow passage
C11 eleventh flow passage
C12 twelfth flow passage
C13 thirteenth flow passage
C14 fourteenth flow passage

The invention claimed is:

1. An outboard motor raising and lowering apparatus configured to raise and lower an outboard motor, the outboard motor raising and lowering apparatus comprising:
one or more tilt cylinders; and
one or more trim cylinders,
each of the one or more trim cylinders including
a piston that partitions each of the one or more trim cylinders into a first chamber and a second chamber, and
a rod that is connected to the piston and that passes through the first chamber of each of the one or more trim cylinders,
each of the one or more tilt cylinders including
a piston that partitions each of the one or more tilt cylinders into a first chamber and a second chamber, and
a rod that is connected to the piston and that passes through the first chamber of each of the one or more tilt cylinders,
the outboard motor raising and lowering apparatus further comprising:
a hydraulic pressure source;
a first fluid passage that connects the hydraulic pressure source, the second chamber(s) of the one or more tilt cylinders, and the second chamber(s) of the one or more trim cylinders;
a second fluid passage that is connected to the first chamber of at least one of the one or more trim cylinders;
a third fluid passage that connects the hydraulic pressure source and the first chamber(s) of the one or more tilt cylinders and that is independent of the second fluid passage; and
at least one switching valve provided at the second fluid passage.

2. The outboard motor raising and lowering apparatus according to claim 1, wherein:
the one or more trim cylinders at least include a first trim cylinder and a second trim cylinder; and
the switching valve is connected to at least one of the first trim cylinder and the second trim cylinder.

3. The outboard motor raising and lowering apparatus according to claim 2, wherein
the switching valve is connected to only one of the first trim cylinder and the second trim cylinder.

4. The outboard motor raising and lowering apparatus according to claim 3, wherein the one or more trim cylinders at least include a first trim cylinder and a second trim cylinder,
the at least one switching valves being a first switching valve and a second switching valve,
the first switching valve being connected to the first chamber of the first trim cylinder,
the second switching valve being connected to the first chamber of the second trim cylinder.

5. The outboard motor raising and lowering apparatus according to claim 1, wherein:
the one or more trim cylinders at least include a first trim cylinder and a second trim cylinder; and
the switching valve is directly connected to the first trim cylinder and the second trim cylinder.

6. The outboard motor raising and lowering apparatus according to claim 1, wherein
the second fluid passage is connected to the first chamber (s) of the one or more tilt cylinders via the switching valve.

7. The outboard motor raising and lowering apparatus according to claim 1,
wherein the second fluid passage is connected with one end of a protective valve at a point between the switching valve and the one or more trim cylinders.

8. The outboard motor raising and lowering apparatus according to claim 1, wherein:
the second fluid passage is connected to a storage tank via the switching valve; and
the second fluid passage is provided with a protective valve such that the protective valve resides between the switching valve and the storage tank.

9. An outboard motor raising and lowering apparatus configured to raise and lower an outboard motor, the outboard motor raising and lowering apparatus comprising:
one or more tilt cylinders; and
one or more trim cylinders,
each of the one or more trim cylinders including
a piston that partitions each of the one or more trim cylinders into a first chamber and a second chamber, and
a rod that is connected to the piston and that passes through the first chamber of each of the one or more trim cylinders,
each of the one or more tilt cylinders including
a piston that partitions each of the one or more tilt cylinders into a first chamber and a second chamber, and a rod that is connected to the piston and that passes through the first chamber of each of the one or more tilt cylinders, the outboard motor raising and lowering apparatus further comprising:

a hydraulic pressure source;

a first fluid passage that connects the hydraulic pressure source, the second chamber(s) of the one or more tilt cylinders, and the second chamber(s) of the one or more trim cylinders;

a second fluid passage that is connected to the first chamber of at least one of the one or more trim cylinders; and at least one switching valve provided at the second fluid passage, the one or more trim cylinders at least including a first trim cylinder and a second trim cylinder, the at least one switching valves being a first switching valve and a second switching valve, the first switching valve being connected to the first chamber of the first trim cylinder, the second switching valve being connected to the first chamber of the second trim cylinder.

10. An outboard motor raising and lowering apparatus configured to raise and lower an outboard motor, the outboard motor raising and lowering apparatus comprising:

one or more tilt cylinders; and one or more trim cylinders, each of the one or more trim cylinders including a piston that partitions each of the one or more trim cylinders into a first chamber and a second chamber, and a rod that is connected to the piston and that passes through the first chamber of each of the one or more trim cylinders, each of the one or more tilt cylinders including a piston that partitions each of the one or more tilt cylinders into a first chamber and a second chamber, and a rod that is connected to the piston and that passes through the first chamber of each of the one or more tilt cylinders, the outboard motor raising and lowering apparatus further comprising:

a hydraulic pressure source;

a first fluid passage that connects the hydraulic pressure source, the second chamber(s) of the one or more tilt cylinders, and the second chamber(s) of the one or more trim cylinders;

a second fluid passage that is connected to the first chamber of at least one of the one or more trim cylinders; and a switching valve provided at the second fluid passage, the outboard motor raising and lowering apparatus further comprising a pump port that is connected to the hydraulic pressure source, the second fluid passage being connected via the switching valve to one, of two chambers of the pump port, which is connected to the first chamber(s) of the one or more tilt cylinders.

11. An outboard motor raising and lowering apparatus configured to raise and lower an outboard motor, the outboard motor raising and lowering apparatus comprising:

one or more tilt cylinders; and one or more trim cylinders, each of the one or more trim cylinders including a piston that partitions each of the one or more trim cylinders into a first chamber and a second chamber, and a rod that is connected to the piston and that passes through the first chamber of each of the one or more trim cylinders, each of the one or more tilt cylinders including a piston that partitions each of the one or more tilt cylinders into a first chamber and a second chamber, and a rod that is connected to the piston and that passes through the first chamber of each of the one or more tilt cylinders, the outboard motor raising and lowering apparatus further comprising:

a hydraulic pressure source;

a first fluid passage that connects the hydraulic pressure source, the second chamber(s) of the one or more tilt cylinders, and the second chamber(s) of the one or more trim cylinders;

a second fluid passage that is connected to the first chamber of at least one of the one or more trim cylinders; and a switching valve provided at the second fluid passage, the outboard motor raising and lowering apparatus further comprising a first pump port and a second pump port each of which is connected to the hydraulic pressure source, the first pump port including a second chamber, a first chamber, a first check valve, and a second check valve, the first chamber of the first pump port being connected via the first check valve to the second chamber of the one or more tilt cylinders, the second chamber of the first pump port being connected via the second check valve to the first chamber of the one or more tilt cylinders, the second pump port including a chamber and a check third valve, the chamber of the second pump port being connected to the first chamber of the first pump port, the first fluid passage being connected to the chamber of the second pump port via the third check valve of the second pump port.

* * * * *